US006044601A

United States Patent [19]

Chmela et al.

[11] Patent Number: 6,044,601

[45] **Date of Patent: *Apr. 4, 2000**

[54] SOFT EDGE MOULDING

[76] Inventors: James Chmela, 1961 Tunbridge Ct., Algonquin, Ill. 60102; John Chmela, 1106 Beech Dr., Mt. Prospect, Ill. 60056

[ * ] Notice: This patent issued on a continued prosecution application filed under 37 CFR 1.53(d), and is subject to the twenty year patent term provisions of 35 U.S.C. 154(a)(2).

[21] Appl. No.: 08/847,376

[22] Filed: Apr. 24, 1997

[51] Int. Cl.[7] ..... E04F 13/06; E04F 19/02

[52] U.S. Cl. ..... 52/287.1; 52/717.03; 52/717.05; 248/345.1; 428/40; 428/122; 428/188; 428/192; 428/343

[58] Field of Search ..... 52/287.1, 717.03, 52/717.05; 248/345.1; 428/71, 35.7, 36.5, 188, 343, 192, 40, 122

[56] References Cited

U.S. PATENT DOCUMENTS

| | | | |
|---|---|---|---|
| 3,712,003 | 1/1973 | Hallock et al. | 248/345.1 |
| 3,869,106 | 3/1975 | Gregov | 52/717.05 |
| 4,012,878 | 3/1977 | Ellingson | 248/345.1 |
| 4,742,916 | 5/1988 | Galea | 248/345.1 |
| 4,877,673 | 10/1989 | Eckel et al. | 428/172 |
| 4,999,233 | 3/1991 | Probst et al. | 428/122 |
| 5,065,972 | 11/1991 | Buckshaw et al. | 248/345.1 |
| 5,131,198 | 7/1992 | Ritchie et al. | 52/287.1 |
| 5,149,575 | 9/1992 | Soifer | 428/188 |
| 5,496,609 | 3/1996 | Michelstein | 52/287.1 |
| 5,584,468 | 12/1996 | Meglino et al. | 256/34 |
| 5,639,072 | 6/1997 | McCall | 248/345.1 |

*Primary Examiner*—Carl D. Friedman
*Assistant Examiner*—Yvonne M. Horten
*Attorney, Agent, or Firm*—Pendorf & Cutliff

[57] ABSTRACT

A soft edge moulding for improving safety, in a preferred embodiment comprising an adhesive backed right-angled rigid transparent thermoplastic part for covering and adhering to a structural edge, and a flexible soft thermoplastic elastomer shield part spaced outward from the edge and designed to protect persons from injury caused by bumping against such an edge. The moulding is preferably made by coextrusion.

17 Claims, 2 Drawing Sheets

SOFT EDGE MOULDING

BACKGROUND OF THE INVENTION

1. Field of the Invention

The present invention is directed to a soft edge safety moulding, and more particularly, to a soft edge moulding comprising a rigid part for adhering along a structural edge and a second part extending outward from said edge and designed to protect persons from injury due to bumping against an unprotected edge. The moulding preferably comprises an adhesive backed right-angled rigid transparent plastic part for covering and adhering to a structural edge, and a flexible soft plastic shield part spaced outward from the edge. The moulding is preferably made by coextrusion.

2. Description of the Related Art

The geometric basis underlying traditional architecture places many sharp structural edges in houses. While these sharp edges may be aesthetically pleasing, they do present the possibility of injury in the case that a person falls against these edges.

For example, small children during play or normal activity are not fully cautious or coordinated, and may bump into these sharp structural edges. Their lack of defensive reflexes and soft skin results in occasional injury.

Many structures in a building must, for functional reasons, be placed in a specific location, which may be in the path of travel of adults. Low cross beams, protruding corners, counter tops, appliances, etc. seem to be placed in a manner designed to attack passers-by.

The elderly are particularly vulnerable to injury by sharp edges. The elderly population has increased steadily to where there are now millions of Americans over the age of 65. Even in healthy individuals, advancing age is frequently accompanied by weakening of the bones, slowing of the circulation, arthritis, insufficient nutrition, a tendency to be less active, diminution of muscle tissue and physical coordination, and an increased likelihood of sustaining injuries resulting from disorientation or loss of balance. With age, the time required to recover from incapacitating physical or mental afflictions becomes longer and longer.

Many elderly are chronically ill, and reside in assisted living facilities or skilled nursing facilities. The prolonged inactivity during inactivity leads to further reduction in muscle and skin tone, loss of circulatory vitality, and diminished physical coordination.

As infirm elderly patients move about in their home or in unfamiliar day care centers or hospitals, they tend to bump themselves. Minor injuries which can be ignored or require no more than a Band-Aid® in the majority of the population tend to cause serious problems in the elderly. The reduced skin strength of the elderly can mean that even a minor impact can produce a serious gash. The reduced circulation and reduced healing rate can turn a small gash or bump into an infected and life-threatening wound or phlebitis. The reduced bone strength can mean that even a minor bump can result in bone fractures.

Various attempts have been made in the past to prevent such painful injuries by provide some sort of covering device for cushioning sharp structural edges. Most attempts involve taping padding, such as pipe insulation, to the sharp edge. This is, however, unattractive and temporary. Other more ingenious devices have been developed. However, the lack of success of any one device appears to be due to any one of complexity, lack of durability, or lack of attractive appearance.

For example, U.S. Pat. No. 4,999,233 (Probst, et al.) teaches a protective guard consisting of an elongated body structure formed of a resilient deformable material sized to cover and cushion a sharp corner on the wall. A complex form of the device may be durable, but is not attractive. A more simplified embodiment of the invention may be more attractive, but would not be durable.

U.S. Pat. No. 5,065,972 (Buckshaw, et al.) teaches a protective bumper comprising a resilient bumper portion configured to provide an air space between the bumper and the corner which it protects, the air space acting as a shock absorber, reducing the risk of injury to a person colliding therewith. Mounting flaps are used to adhere the bumper to the corner. The device, however, is designed to only protect a small segment of a corner and edge. The device would be unattractive if modified to be applied along a long section of architectural edging.

U.S. Pat. No. 4,877,673 (Eckel, et al.) teaches an L-shaped edge protector. While the edge protector may protect corners, it provides very little protection to persons bumping against such corners.

Recently, there has been an effort by the government, the public, health insurance companies, and health-maintenance organizations to lower medical care costs through preventative measures. Undoubtedly, the prevention of serious complications arising from superficial injuries would be of great benefit in lowering the cost of administering health care to the young and elderly alike.

Accordingly, there is a need for a device for protecting persons from sharp edges, which device will not detract from the appearance of a residence public facility, is easy to install, and is durable.

SUMMARY OF THE INVENTION

It is an object of the present invention to provide an edge protector for protecting persons from sharp structural edges, which device will not detract from the appearance of a residence public facility, is easy to install, and is durable.

It if a further object of the invention to provide a device which will protect persons from injury resulting from impact with sharp edges or corners, thus enabling the young and the elderly to freely move about without fear of bruising or causing skin lesions that have the potential of evolving into life-threatening wounds.

These and other objects of the invention are accomplished by a moulding for covering edge formed at the junction of structural walls, the moulding comprising: an edge cover for engaging structural walls and an edge, the edge cover having a cross-section comprising first and second legs joined to form a "V", each leg having an inside and an outside, the leg insides defining an angle less than 180° and the leg outsides defining an angle greater than 180°; a resilient arcuate shield which when viewed in cross section has a first edge mated to the outside of the first leg and a second edge mated to the outside of the second leg, the cross sectional profile of the moulding remaining constant along the length of the moulding.

The moulding is preferably made of transparent plastic materials. The moulding is preferably made by coextrusion of a hard plastic and a soft plastic.

The foregoing has outlined rather broadly the more pertinent and important features of the present invention in order that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other edge protectors for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a fuller understanding of the nature and objects of the present invention reference should be made by the following detailed description taken in with the accompanying drawings in which.

DETAILED DESCRIPTION OF THE INVENTION

Figure 1:
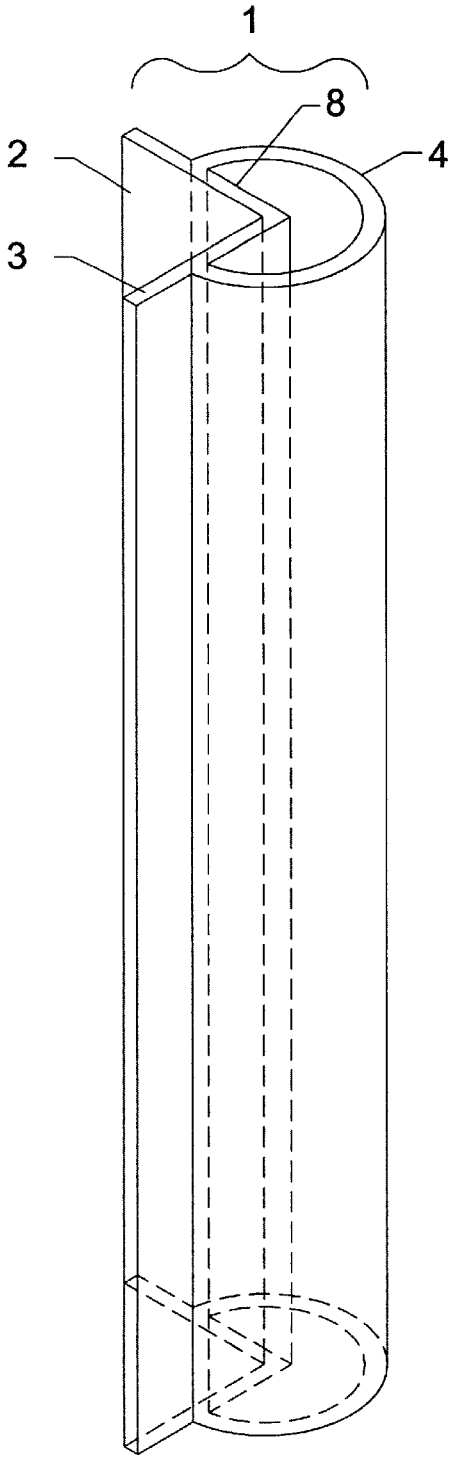
FIG. 1 is a side elevated view of a transparent soft edge moulding.

The present inventors extensively constructed and experimented with various edge protectors such as foam protectors, wire-reinforced protectors, solid plastic protectors, and others and found that such devices are not attractive following installation. Edge protectors which are not attractive will not be adopted and installed, and thus are ineffective.

The present inventors finally discovered that the best combination of protection, ease of installation, and appearance are achieved by a moulding for covering edge formed at the junction of structural walls, the moulding comprising: an edge cover for engaging structural walls and an edge, the edge cover having a cross-section comprising first and second legs joined to form a "V", each leg having an inside and an outside, the leg insides defining an angle less than 180° and the leg outsides defining an angle greater than 180°; a resilient arcuate shield which when viewed in cross section has a first edge mated to the outside of the first leg and a second edge mated to the outside of the second leg, the cross sectional profile of the moulding remaining constant along the length of the moulding. The inside angle is any angle necessary to mate with an edge, and is conventionally less than 120°, more conventionally less than 110°, usually between 100° and 80°, usually about 90°.

The moulding may be designed to be nailed, stapled, tacked, taped, or glued to a structural edge, but for ease and convenience of installation the inside or back of the moulding is preferably provided with longitudinal strips of contact adhesive covered with a plastic release strip. Pulling and removing the plastic release strip exposes the adhesive, such that installation requires only pressing the edge moulding with light pressure against the edge to be protected.

The moulding may be provided in lengths such as 4 foot, 8 foot, and 12 foot. The cross section of the moulding is constant along the entire length of the moulding.

While there is no particular limitation as to the possible materials and colors of the soft edge moulding according to the invention, the moulding is preferably made of transparent plastic materials, and is preferably made by coextrusion of a hard plastic and a soft plastic.

In it's simplest form, the soft corner moulding is made by coextruding two thermoplastic formulations, preferably a rigid or semi-rigid thermoplastic formulation for the corner covering and a pliable, deformable, resilient thermoplastic elastomer formulation for the shield component, the two formulations being compatible, that is, when coextruded form a good seam and adhere well to each other. One particular preferred material is a polyvinyl chloride thermoplastic material which is formulated to be rigid for the corner protecting part and a soft, flexible thermoplastic elastomer for the shield part.

While the composition of the impact absorbing or impact attenuating shield of the present invention is not particularly limited except by functional properties (it is preferably the consistency of a plastic or rubber hose), it is preferably a thermoplastic elastomer having a Shore A Hardness of from 25 to 98, more preferably from 40 to 80, as defined in the *Handbook of Plastics, Elastomers, and Composites*, Charles A. Harper, Second Ed. 1992, McGraw Hill, and particularly, Chapter 7 entitled "Thermoplastic Elastomers", and in *Plastics Engineering Handbook of the Society of the Plastics Industry*, Michael L. Berins, Fifth ed., 1991, pages 72 and 73. Examples of thermoplastic elastomers include thermoplastic polyurethanes, styrenic block copolymers, copolyesters, olefin blends, rubber olefin alloys, neoprene, ureaformaldehyde, polyvinyl-formaldehyde plastic, polyester resin reacted with aromatic diisocyanates to form a prepolymer which is then reacted with water to form a plastic urethane polymer, phenolformaldehyde resins, and polystyrene, or any other such natural or synthetic material known to those in the art with suitable properties such as resiliency, durability, good extrudability, good appearance, and impact absorption abilities. See, e.g., U.S. Pat. No. 5,555,913.

The thickness of the shield layer may vary widely depending upon softness of the shield material and engineering preferences, but is preferably about 0.5–3.0 mm, more preferably 0.75–2.0 mm, most preferably about 1.0–1.5 mm. A shield thicker than 3 mm inch does not provide significant additional protection of the type with which the present invention is concerned, yet is increased in manufacturing cost and is less deformable and resilient. A shield less than 0.75 mm in thickness is reduced in the amount of protection afforded, and less than 0.5 mm generally does not give sufficient protection, even if the shield material is made thicker.

The length of each leg, measured radially from the corner, may vary depending upon use (domestic vs. industrial), and is preferably in the range of 1–4 cm, preferably about 1–2 cm.

The edge cover part can be any rigid or semi-rigid polymer, preferably a thermoplastic polymer with a Shore D hardness of from 40 to 74, such as an extrudable polyvinyl chloride, ethylene/methacrylic acid base copolymer, a high density polyethylene copolymer, any of the polyolefins, such as polypropylene and polyethylene, polyethylene terephthalate, polystyrene, acrylonitrilestyrene-butadiene polymer, nylon, acetal polymer, polycarbonate, nitrile resins, polyvinyl alcohol, polysulfone and other semi-rigid to rigid polymers including multipolymers, polymer blends and polymer laminar constructions thereof having enhanced properties such as impact resistance and smooth surfaces.

The selection of specific thermoplastics as necessary to produce any of a wide variety of mouldings is well known to those working in the art and need not be discussed in greater detail.

The thickness of the edge cover may vary widely depending upon materials selected, individual preference and intended utility.

Preferred soft edge protective mouldings according to the invention will now be discussed in greater detail by reference to the drawings.

FIG. 1 shows a soft edge moulding 1. The moulding comprises a right angled edge cover 8 made from DURAL 400™ CLEAR rigid, extrusion grade, clear (with custom colors available) polyvinyl chloride based polymer having a Shore D hardness of 78, a tensile modulus (Young's Modulus), psi of 436,000, a flexural modulus of 443,000, and a Gardner Impact of 3.8 mil available from AlphaGary. The moulding also comprises a generally cylindrical shield 4 of PVC 3019–40/45 made by AlphaGary with a durometer Shore A hardness of 40/45 (⅛") or 35/45 (¼"). Edge cover 8 comprises a first leg 2 and a second leg 3 which meet to form a corner 5. Legs 2 and 3 are generally at right angles to each other in conformance with the generally right angled structural junctions found in conventional architecture.

Figure 2:
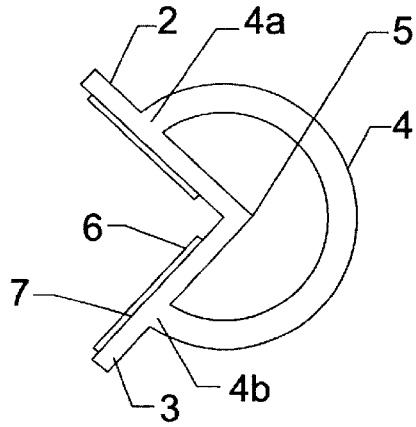
FIG. 2 is a cross-sectional view through the moulding of FIG. 1.
Figure 3:
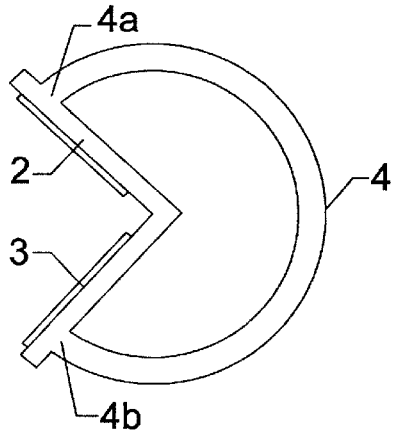
FIG. 3 is a cross-sectional view of a variation on FIG. 2, showing the shield attached near the edges of the edge protector.
Figure 4:
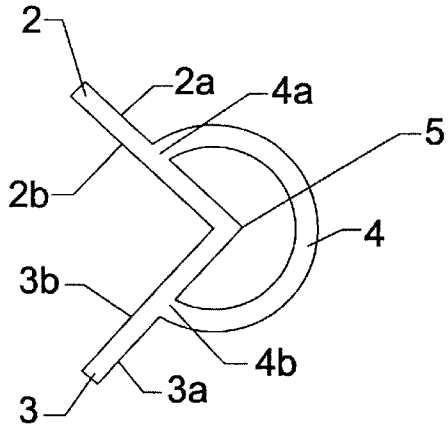
FIG. 4 is a cross-sectional view of a variation on FIG. 2, showing the shield attached near the corner of the "V" formed in the edge protector.

As seen from FIG. 2, shield 4 is in the shape of an arch with a first end 4*a* connected to the first leg 2 of the edge protector and a second edge 4*b* connected to the second leg 3 of the edge protector. FIGS. 3 and 4 show variations on the embodiment of FIG. 2, wherein shield 4 is attached further away from the corner 5 of edge protector 8, and FIG. 4 shows an embodiment wherein the edges 4*a*, 4*b* of shield 4 are attached closer to the corner 5 of edge protector 8.

FIG. 2 shows an embodiment of the present invention provided with a contact adhesive 7 and peel off strip 6. Upon peeling off of strip 6 edge protector 8 can be attached to a structural edge by simply pressing with light pressure.

Figure 6:
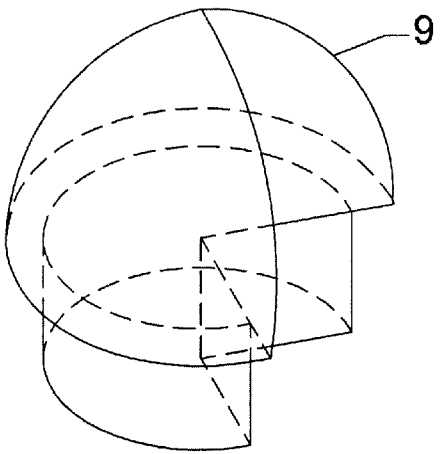
FIG. 6 is an oblique elevated view of a transparent end cap designed to engage with an end of the edge moulding of FIG. 1.
Figure 7:
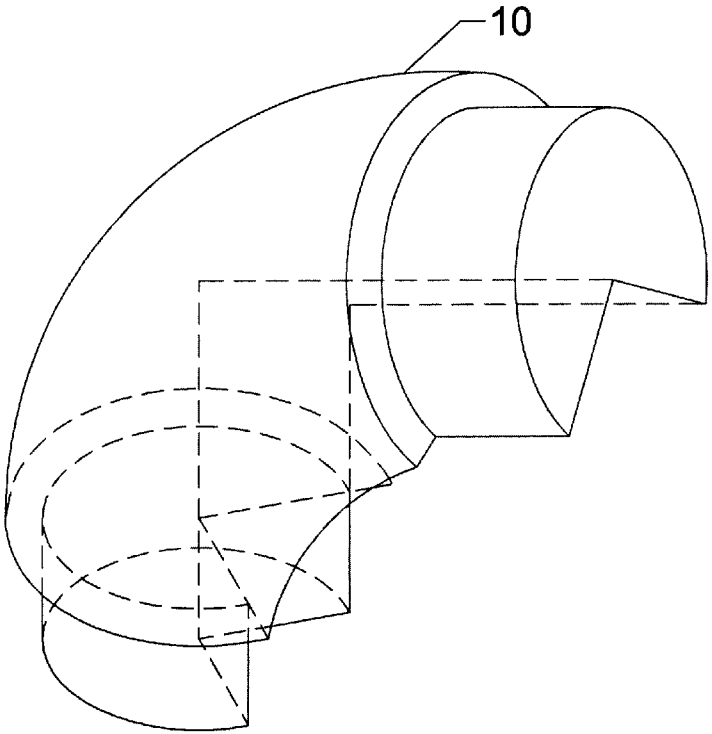
FIG. 7 is an oblique elevated view of a corner piece adapted for fitting on a corner and engaging with two ends of edge moulding of FIG. 1.

The edge moulding can be cut to any desired length and used as it is. Alternatively, primarily for decorative purposes, an exposed end of the edge moulding can be capped using a cap such as shown in FIG. 6. In the case that the moulding is intended to run along a corner, a corner piece 10 such as shown in FIG. 7 can be used to connected edge moulding along the two edges which meet to form the corner.

The operation of the edge moulding will now be explained in greater detail.

The edge moulding 1 can be applied along an edge in any conventional manner, such as nailing, stapling, tacking, gluing with hot melt or conventional adhesive materials, etc. In a preferred embodiment of the invention the moulding is provided with a contact adhesive and is simply applied to any desired structural edge by peeling off the cover strip and adhering with pressure against an edge to be protected.

Figure 5:
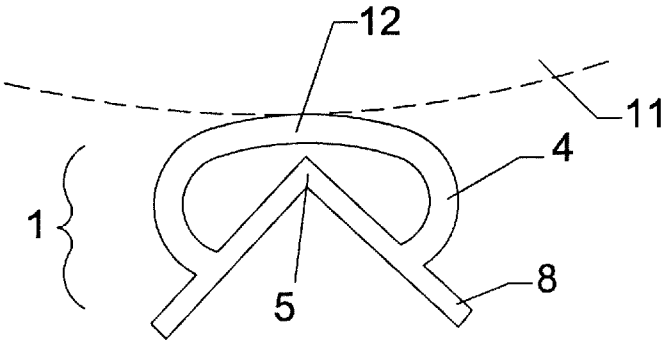
FIG. 5 is a cross-sectional view of the edge moulding deformed by contact with an object.

Once in place, the edge moulding will protect persons from injury which would result in a case that a person impacts against a sharp edge which does not have an edge protector. With reference to FIG. 5, a person 11 pushing against the shield 4 will cause the arcuate shape of the shield to deform such that a generally planar section of shielding material 12 is formed between person 11 and edge 5. Edge protector 1 thus protects by a combination of factors including (a) the deformability and resiliency of the shield 4, (b) the air cushion provided between the shield 4 and corner protector 8, and (c) the generally the generally planar and impact distributing property of shield 4 in the area 12 between a person 11 and corner 5 upon impact.

In the case that the edges of the edge end protector 1 are capped by edge caps 9, the gas volume is confined within a cylinder and thus the internal volume between shield 4 and edge protector 8 acts as a gas shock absorber.

In the case that the soft edge moulding is made of an entirely transparent material, the end product once installed is nearly invisible to the human eye and easily disregarded. It thus does not detract from the aesthetic appearance which the original architect intended to accomplish with the design of the domestic or business structure.

The edge moulding can be manufactured by any conventional method including separately manufacturing the corner protector and shield portions and adhering these together by thermal or adhesive means, or any other method conventional in the art. Preferably, the moulding is manufactured by coextrusion, with a first rigid or semi-rigid thermoplastic material being extruded to form the edge protector 8 and a softer, more flexible, resilient and deformable thermoplastic elastomer material being extruded at the same time to form shield portion 4. Coextrusion is preferred for reasons of consistency of manufacture, good bonding between corner protector and shield, and lack of any bonding lines at points 4*a* and 4*b*.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

Now that the invention has been described,

What is claimed is:

1. An elongated moulding for covering an edge formed at the junction of structural walls, and said moulding comprising:

an edge cover for engaging structural walls at said edge; the edge cover formed of a semi-rigid to rigid thermoplastic polymer, and when viewed in cross section having first and second legs joined to form a corner, each leg having an inside and an outside, the leg insides defining an angle less than 180°, and the leg outsides defining an angle greater than 180°; and a resilient arcuate shield formed of a resilient thermoplastic elastomer which is compatible with the semi-rigid thermoplastic polymer, and which when viewed in cross section, has a first edge mated to the outside of the first leg and a second edge mated to the outside of the second leg, wherein the cross sectional profile of the moulding remains constant along the length of the moulding, and the cross sectional reveals seamless bonding of the semi-rigid to the rigid thermoplastic polymer.

2. A moulding as in claim 1, wherein said inside angle is less than 120°.

3. A moulding as in claim 1, wherein said inside angle is less than 100° and more than 80°.

4. A moulding as in claim 1, wherein said inside angle is approximately 90°.

5. A moulding as in claim 1, wherein said moulding is made transparent materials.

6. A moulding as in claim 1, wherein said moulding is made by simultaneous coextrusion of a semi-rigid to rigid thermoplastic polymer to form said edge cover and a resilient thermoplastic elastomeric polymer to form said shield.

7. A moulding as in claim 1, wherein said semi-rigid to rigid polymer has Shore D hardness of from 40 to 74.

8. A moulding as in claim 1, wherein said semi-rigid to rigid polymer is a polyvinyl chloride.

9. A moulding as in claim 6, wherein said resilient polymer has a Shore A hardness of from 25 to 98.

10. A moulding as in claim 6, wherein said resilient polymer is a polyvinyl chloride.

11. A moulding as in claim 1, wherein said shield is generally semi-circular.

12. A moulding as in claim 11, wherein said shield is from 1–3 cm in diameter.

13. A moulding as in claim 12, wherein said shield is from 1–2 cm in diameter.

14. A moulding as in claim 1, wherein said shield is generally semi-circular and coaxial with the corner formed in said edge cover.

15. A moulding as in claim 1, further comprising end caps designed to matingly engage ends of said moulding for confining a gas volume in the space between the edge cover and the arcuate shield.

16. A moulding as in claim 1, further comprising a corner piece, wherein said corner piece includes a first receptacle for engaging a first length of moulding and a second receptacle for engaging a second length of moulding, and where said first receptacle is oriented perpendicular to said second receptacle, such that first receptacle receives a first length of moulding and said second receptacle receives said second length of moulding 90° from said first moulding.

17. An elongated moulding for covering an edge formed at the junction of structural walls, said moulding comprising:

an edge cover for engaging structural walls and an edge, the edge cover when viewed in cross section having first and second legs joined to form a corner, each leg having an inside and an outside, the leg insides defining an angle less than 180°, and the leg outsides defining an angle greater than 180°;

a resilient arcuate shield which when viewed in cross section has a first edge mated to the outside of the first leg, and a second edge mated to the outside of the second leg;

said moulding being formed by coextrusion of a semi-rigid to a compatible rigid thermoplastic polymer having a Shore D hardness of from 40 to 74 and a resilient thermoplastic elastomeric polymer having a Shore A hardness of from 25 to 98, said semi-rigid to rigid thermoplastic polymer forming said edge cover and said resilient thermoplastic elastomer forming said resilient arcuate shield; and wherein the cross sectional profile of the moulding remains constant along the length of the moulding, and, the cross sectional reveals seamless bonding of the semi-rigid to the rigid thermoplastic polymer.

* * * * *